US005538237A

United States Patent [19]

Miyauchi

[11] Patent Number: 5,538,237

[45] Date of Patent: Jul. 23, 1996

[54] SHEET SUPPLYING APPARATUS

[75] Inventor: Yasuo Miyauchi, Machida, Japan

[73] Assignee: Canon Kabushiki Kaisha, Tokyo, Japan

[21] Appl. No.: 461,772

[22] Filed: Jun. 5, 1995

Related U.S. Application Data

[63] Continuation of Ser. No. 125,816, Sep. 24, 1993, abandoned.

[30] Foreign Application Priority Data

Sep. 29, 1992 [JP] Japan ..... 4-260267
Dec. 25, 1992 [JP] Japan ..... 4-357716

[51] Int. Cl.[6] ..... B65H 3/06

[52] U.S. Cl. ..... 271/117; 271/3.05; 271/127; 400/691

[58] Field of Search ..... 271/3.01, 3.05, 271/3.14, 117, 126, 127, 145, 162; 400/680–685, 691, 693

[56] References Cited

U.S. PATENT DOCUMENTS

| | | | |
|---|---|---|---|
| 3,827,687 | 8/1974 | Kono | 271/162 X |
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,558,333 | 12/1985 | Sugitani et al. . | |
| 4,723,129 | 2/1988 | Endo et al. . | |
| 4,740,796 | 4/1988 | Endo et al. . | |
| 4,828,416 | 5/1989 | Pensavacchia et al. | 400/691 X |
| 5,126,764 | 6/1992 | Miyauchi et al. . | |
| 5,127,642 | 7/1992 | Takimoto et al. | 271/3.1 X |
| 5,236,265 | 8/1993 | Saito et al. | 400/680 X |

FOREIGN PATENT DOCUMENTS

| | | | |
|---|---|---|---|
| 418740 | 3/1991 | European Pat. Off. | 271/3 |
| 54-056847 | 5/1979 | Japan . | |
| 59-123670 | 7/1984 | Japan . | |
| 59-138461 | 8/1984 | Japan . | |
| 60-071260 | 4/1985 | Japan . | |
| 63-192113 | 8/1988 | Japan . | |
| 63-252766 | 10/1988 | Japan . | |
| 5-124301 | 5/1993 | Japan . | |
| WO90/13433 | 11/1990 | WIPO . | |

*Primary Examiner*—William E. Terrell
*Assistant Examiner*—Boris Milef
*Attorney, Agent, or Firm*—Fitzpatrick, Cella, Harper & Scinto

[57] ABSTRACT

The present invention provides a sheet supplying apparatus comprising first and second frames shiftable relative to each other, a sheet receiving portion provided on the first frame for receiving a sheet, and a rotary member provided on the second frame for cooperating with the sheet receiving portion to thereby pinch and supply the sheet when a relative position between the first and second frames is in a first configuration and separated from the sheet receiving portion when the relative position between the first and second frames is in a second configuration.

11 Claims, 8 Drawing Sheets

SHEET SUPPLYING APPARATUS

This application is a continuation of U.S. patent application Ser. No. 08/125,816 filed Sep. 24, 1993, now abandoned.

BACKGROUND OF THE INVENTION

1. Field of the Invention

The present invention relates a sheet supplying apparatus applied to a recording apparatus for recording a character or an image on a recording material.

DESCRIPTION OF THE RELATED ART

A conventional recording apparatus including a sheet supplying apparatus and having a printing, copying or facsimile function, or a conventional recording apparatus used as an output means for a copying machine or work station including a computer or a word processor is designed so that an image (including characters and/or symbols) is recorded on a recording medium such as a paper sheet or a plastic thin film ( for example, an OHP sheet ) on the basis of a data signal. Such recording apparatuses can be grouped into an ink jet type, a wire dot type, a heat-sensitive type, a heat transfer type and a laser beam type, in dependence upon recording types.

In a recording apparatus of a serial type wherein a main scan is effected along a direction transverse to a feeding direction (sub scan direction) of a recording material, after the recording material is set at a predetermined recording position, an image is recorded (main scan) on the recording material by a recording means (recording head) mounted on a carriage shifted along the recording material. After one-line of recording is finished, the recording material is line-spaced (sub scan) by a predetermined amount. Thereafter, by repeating the recording (main scan) of the next line of the image, the whole image is recorded on the recording material.

On the other hand, in a recording apparatus of a line type wherein an image is recorded on a recording material only by the sub scan which is effected along a feeding direction of the recording material, after the recording material is set at a predetermined recording position and then one-line recording is effected collectively, the recording material is fed (pitch feed) by a predetermined amount. By repeating the collective recording of the next line of the image, the whole image is recorded on the recording material.

Among these recording apparatuses, a recording apparatus of an ink jet type (ink jet recording apparatus) is so designed that the recording is effected by discharging ink droplets from discharge openings of a recording means (recording head) toward a recording material in response to a data signal. Thus, in this apparatus, the recording means can easily be made compact and the fine image can be recorded at a high speed. Further, since the image can be recorded on a normal sheet without special treatment, it is possible to reduce the running cost. Furthermore, due to the non-impact recording type, the recording noise can be reduced, and a color image can easily be recorded by using inks of different color.

In a recording means (recording head) of an ink jet type wherein ink is discharged by utilizing thermal energy, since the high density liquid passage arrangement (discharge opening arrangement) can easily be attained by forming electro-thermal converters and electrodes deposited on a substrate, liquid passage walls, a top wall and the like by semi-conductor manufacture process such as etching, depositing and spattering, it is possible to make the recording means further compact.

Recently, host computers such as personal computers have been made small-sized, and notebook-shaped computers having A4 size have been widely popularized. Correspondingly, small-sized recording apparatuses as output means have also been developed to provide a notebook-type apparatus and an elongate parallelpiped-type apparatus which are portable and can be accommodated in a drawer of a desk.

However, as the recording apparatus is made small-sized to enhance portability and accommodation ability, the optimum configuration of the recording apparatus in its operative condition greatly differs from the optimum configuration of the recording apparatus in its inoperative condition. That is to say, if the configuration of the recording apparatus is permanently made small-sized to obtain the best configuration in its operative condition, the configuration in its inoperative condition will become unsuitable; whereas, if the configuration of the recording apparatus in its inoperative condition is made optimum, the configuration in its operative condition will become unsuitable.

To avoid this, as disclosed in Japanese Patent Laid-open No. 5-124301 (U.S. patent application Ser. No. 968,327), there has been proposed a recording apparatus which is of a foldable type to assume two configurations so that both the optimum configuration in its operative condition and the optimum configuration in its inoperative condition can be obtained.

However, an automatic sheet supplying apparatus and/or a jam treatment apparatus cannot be incorporated into this recording apparatus, because, if the automatic sheet supplying apparatus or the jam treatment apparatus is incorporated into this recording apparatus, the whole recording apparatus will be large-sized, which is contrary to the expected purpose for making the apparatus compact. Accordingly, in this recording apparatus, there arose problems that the sheet supplying operation is troublesome and that the recording efficiency is worsened.

Further, in conventional recording apparatuses, although the stability in the operative condition and the downward recording ability were preserved, there arose a problem that it is difficult to handle the apparatus in the accommodation condition or the portable condition because of the presence of the play in hinge portions.

SUMMARY OF THE INVENTION

The present invention aims to eliminate the above-mentioned conventional drawbacks, and has as an object to provide a sheet supplying apparatus which is suitable to be applied to an image recording apparatus and which can satisfy the compactness of the recording apparatus and stabilize the recording apparatus in its accommodation condition and in its portable condition.

Another object of the present invention is to provide a recording apparatus which is made small-sized and which includes an automatic sheet supply means and a jam treatment means.

To achieve the above objects, according to one aspect of the present invention, there is provided a sheet supplying apparatus used with a recording apparatus wherein a recording means for recording an image on a recording material is arranged on one of first and second frames which are rotatably connected to each other. The sheet supplying apparatus comprises an automatic sheet supply means including a receiving portion for receiving a supplied recording material and a roller portion rotatable in a supplying direction of the recording material, wherein one of the roller portion and the receiving portion is moved toward and away the other of these portions synchronously with the rotation of the first or second frame.

In another aspect of the present invention, there is provided a sheet supplying apparatus used with a recording apparatus including an integral constructural member comprising two molded pieces connected to each other for rotational movements about a common axis at their one ends, and a cover member adapted to be shiftably engaged by one surface of the constructural member, wherein the cover member is attached to the constructural member to provide a rotation preventing means and a recording material receiving tray mechanism.

DETAILED DESCRIPTION OF THE PREFERRED EMBODIMENTS

The present invention will now be explained in connection with embodiments thereof with reference to the accompanying drawings.

Figure 1:
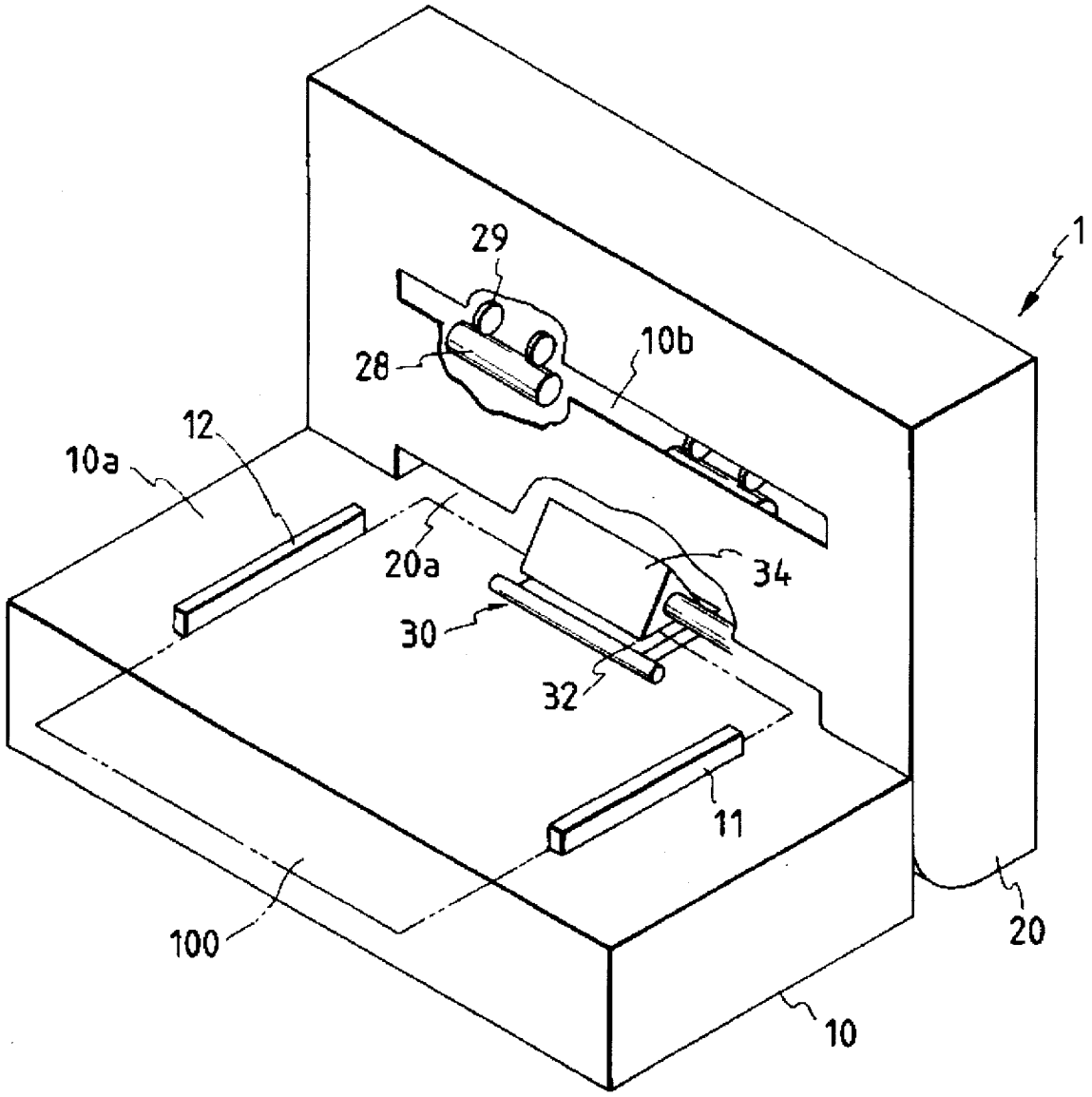
FIG. 1 is a schematic perspective view of a recording apparatus using a sheet supplying apparatus according to a first embodiment of the present invention.

FIG. 1 is a schematic perspective view showing a first embodiment of the present invention.

A recording apparatus 1 according to the first embodiment comprises first and second frames 10, 20 which are rotatably connected to each other and in which parts of a recording mechanism are housed, and an automatic sheet supplying mechanism (automatic sheet supply means) 30 which permits the supply of a recording sheet (recording material) 100.

The first frame 10 also serves as a sheet supply platform, and a pair of parallel side guides 11, 12 are formed on an upper surface 10*a* of the first frame. The side guides 11, 12 can be relatively shifted in a widthwise direction to set the recording sheet 100.

Figure 2:
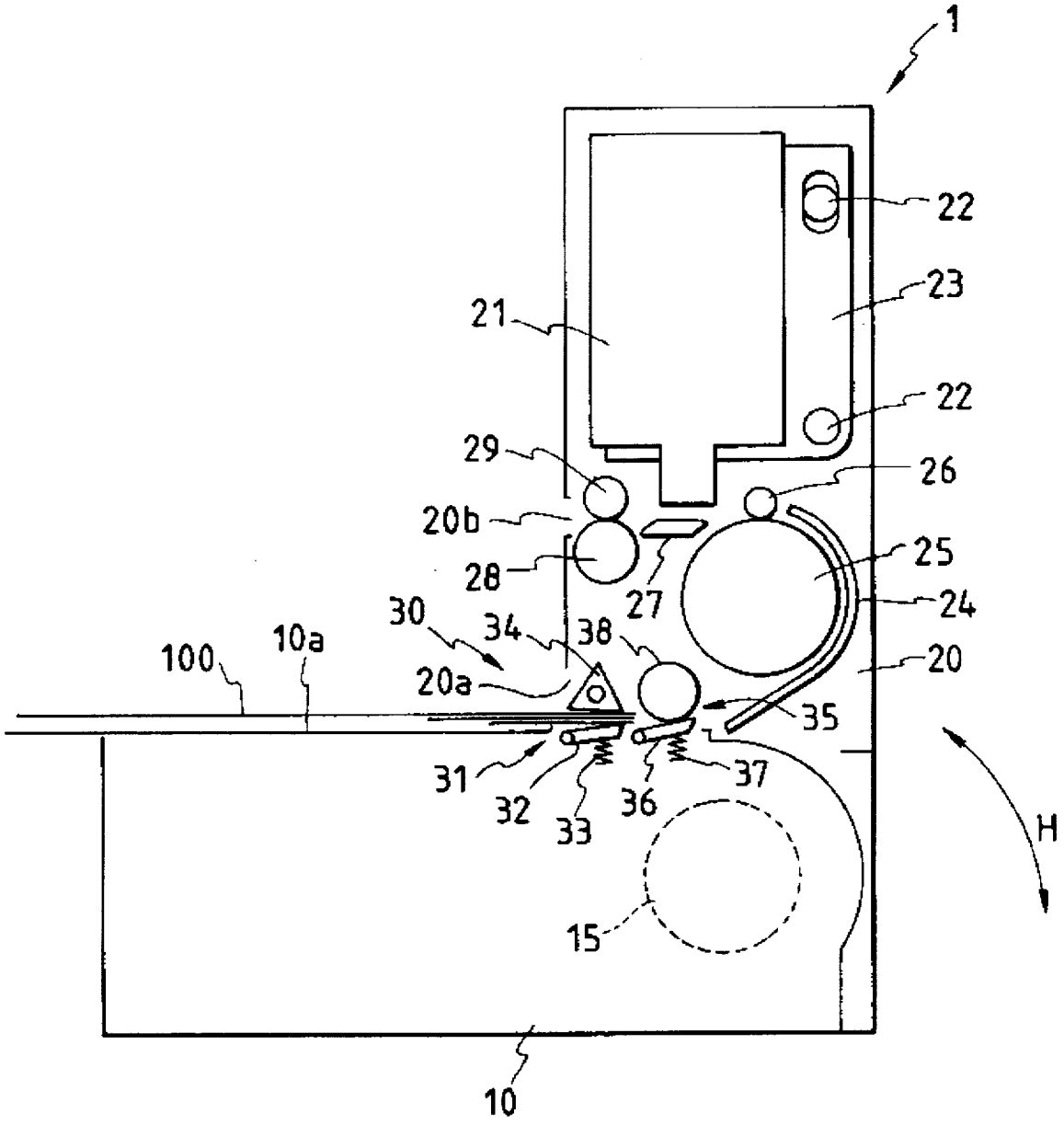
FIG. 2 is a schematic sectional view of the recording apparatus of FIG. 1 in its operative condition.

On the other hand, as shown in FIG. 2, the second frame 20 is connected to the first frame 10 via hinges 15 so that it can be rotated around the hinges 15 in directions shown by the arrow H within a range of 0 to 90 degrees. An ink jet head (recording means) 21 is housed-in the second frame 20.

The ink jet head 21 is designed so that bubbles are generated in the ink by utilizing thermal energy, thereby forming ink droplets in response to a recording signal, which ink droplets are projected toward the recording sheet 100 to form an image on the recording sheet. The ink jet head 21 is mounted on a carriage 23 shifted along rails 22 in the widthwise direction of the recording sheet.

A sheet convey mechanism for directing the recording sheet to the ink jet head 21 is formed in the second frame 20. The sheet convey mechanism comprises a convey roller 25, a guide 24 disposed along the convey roller 25, a pinch roller 26 urged against the convey roller 25 and adapted to pinch the recording sheet 100 between the rollers 25, 26 and feed out the recording sheet therefrom, and a pair of sheet discharge rollers 28, 29 for discharging the recording sheet 100, on which an image is formed by the ink jet head 21, through a sheet discharge opening 20*b*.

Accordingly, when the recording sheet 100 is manually inserted into the guide 24, the recording sheet 100 can be supplied between the ink jet head 21 and a platen 27 by the rotations of the convey roller 25 and the pinch roller 26. In the recording apparatus 1 according to the illustrated embodiment, there is provided the automatic sheet supplying mechanism 30 capable of automatically supplying a plurality of recording sheets 100 between the ink jet head 21 and the platen 27.

The automatic sheet supplying mechanism 30 has a feed-in portion 31 and a separation portion 35. The feed-in portion 31 comprises a friction plate (receiving portion) 32 supported by a spring 33 (a lower end of which is secured to the first frame 10) to be flush with the upper surface 10*a* of the sheet supply platform, and a feed-in roller (roller portion) 34 attached to the second frame 20 and having an equilateral triangular cross-section, which feed-in roller is rotated in a feed-in direction by a motor (not shown).

The feed-in roller 34 is arranged in the proximity of a sheet supply opening 20*a* so that, when the second frame 20 is folded at an angle of 90 degrees (with respect to the first frame) as shown in FIG. 2, the feed-in roller is opposed to the friction plate 32 with a predetermined gap therebetween. In a condition that the recording sheet 100 is not set, when the feed-in roller 34 is rotated, it can be contacted with the friction plate 32 intermittently. Thus, when a plurality of recording sheets 100 are set between the friction plate 32 and the feed-in roller 34 (in a condition that one lateral side of the triangle of the feed-in roller is parallel with the friction plate 32) and then the feed-in roller 34 is rotated, several upper recording sheets 100 are fed out toward the separation portion 35 by apexes of the triangle of the feed-in roller 34.

The separation portion 35 comprises a friction plate (receiving portion) 36 supported by a spring 37 (a lower end of which is secured to the first frame 10) to be flush with the friction plate 32, and a separation roller (roller portion) 38 rotated synchronously with the feed-in roller 34.

The separation roller 38 is arranged rearwardly of the feed-in roller 34 so that, when the second frame 20 is folded at an angle of 90 degrees (with respect to the first frame) as shown in FIG. 2, the separation roller is contacts the friction plate 36. Thus, the several recording sheets 100 fed from the feed-in portion 31 are separated one by one (from the uppermost one) by the separation portion 35, and the separated recording sheet is fed toward the guide 24.

Next, an operation of the recording apparatus according to the illustrated embodiment will be explained.

First, the operation of the recording apparatus 1 in its operative condition will be described with reference to FIGS. 1 and 2.

As shown in FIGS. 1 and 2, the recording apparatus 1 is operated in a condition that the second frame 20 is folded at the angle of 90 degrees with respect to the first frame 10.

In a condition that the motor is stopped, the recording sheets 100 are set in the feed-in portion 31 of the automatic sheet supplying mechanism 30. More specifically, in the condition that the motor is stopped, since the lower side of the feed-in roller 34 of the feed-in portion 31 is parallel with the friction plate 32 to create the gap therebetween, the plurality of recording sheets 100 are stacked on the upper surface 10*a* of the sheet supply platform and a leading end of the sheet stack is inserted into the gap.

When a predetermined recording signal is sent from a computer (not shown), the motor is operated to rotate the feed-in roller 34 in a recording sheet feeding direction (anti-clockwise direction in FIG. 2). As a result, several upper recording sheets 100 are fed into the separation portion 35.

In the separation portion 35, the separation roller 38 separates the uppermost recording sheet 100 from the other, and the separated recording sheet is pinched between the separation roller 38 and the friction plate 36 and then is sent to the guide 24. In this way, the automatic sheet supply is effected.

The recording sheet 100 sent to the guide 24 is guided toward the pinch roller 26 by the guide 24 and then is pinched between the convey roller 25 and the pinch roller 26. At this point, the feed-in roller 34 of the feed-in portion 31 and the separation roller 38 of the separation portion 35 are stopped, and thereafter, the recording sheet 100 is sent between the ink jet head 21 and the platen 27 by the rotations of the convey roller 25 and the pinch roller 26.

When a leading end of the recording sheet 100 reaches a predetermined position on the platen 27, the convey roller 25 and the pinch roller 26 are stopped, and the carriage 23 is controlled by a motor (not shown) different from the above-mentioned motor. That is to say, the carriage 23 is reciprocally moved along the rail 22 by the discrete motor so that the image or character is recorded on the recording sheet 100 by the ink jet head 21 mounted on the carriage 23 in response to the recording signal.

More specifically, when the ink jet head 21 is shifted in the widthwise direction of the recording sheet, one-line recording (main scan) is effected. When the one-line recording is finished, the ink jet head 21 is returned to its original position and the convey roller 25 and the pinch roller 26 are rotated to feed the recording sheet 100 toward the sheet discharge rollers 28, 29 by a predetermined amount. Then, a next one-line recording is effected. By repeating such operations, the recording is effected on the whole area of the recording sheet 100. After the recording is completed, the recording sheet 100 is discharged out of the recording apparatus through the sheet discharge opening 20*b* by the rotation of the discharge rollers 28, 29. The above-mentioned sequence is repeated for the desired number of recording sheets 100 (to be recorded) supplied by the automatic sheet supplying mechanism 30. After the desired number of recording sheets are recorded, the recording apparatus is stopped.

Next, the jam treatment condition and the configuration of the recording apparatus in the inoperative condition will be explained with reference to FIG. 3.

Figure 3:
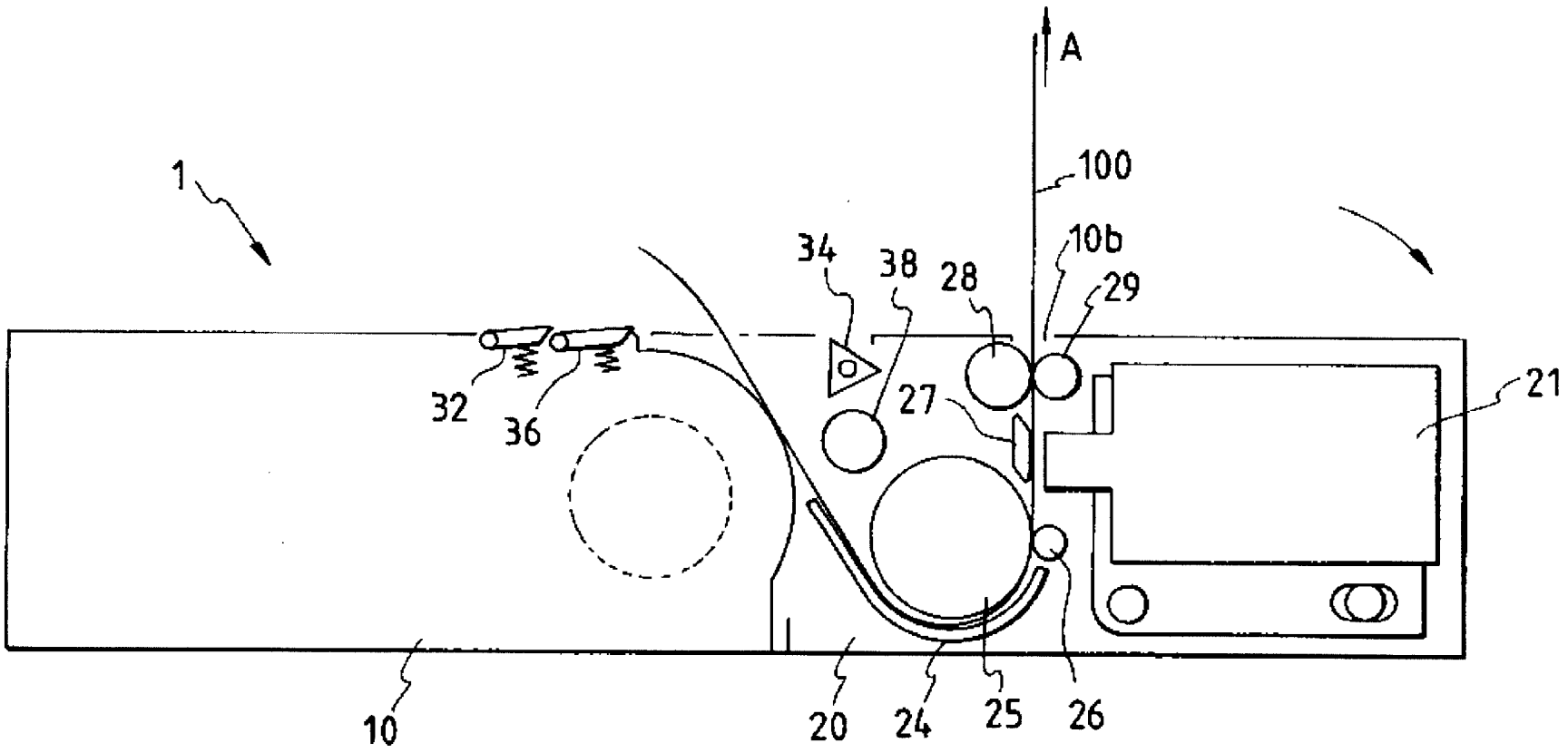
FIG. 3 is a schematic sectional view of the recording apparatus of FIG. 1 in its inoperative condition.

If the recording sheet 100 is jammed during the recording operation, as shown in FIG. 3, the recording apparatus 1 is made flat by rotating the second frame 20. As a result, the feed-in roller 34 and the separation roller 38 of the automatic sheet supplying mechanism 30 are separated from the friction plates 32, 36, respectively, thereby releasing the urging forces from the jammed recording sheet 100. Accordingly, in this condition, by pulling the recording sheet 100 in a direction shown by the arrow A, it is possible to easily remove the jammed recording sheet 100 from the recording apparatus 1.

Further, when the recording apparatus 1 is not used, the whole recording apparatus 1 is made flat as a notebook by rotating the second frame 20, thereby making the accommodation of the apparatus easy.

In this way, in the recording apparatus 1 according to the illustrated embodiment, since the apparatus can assume two configurations and the automatic sheet supply and the jam treatment can be performed only by changing the configuration of the apparatus, the compactness of the apparatus and the improved recording efficiency can be achieved.

Incidentally, various alterations can be effected within the scope of the present invention. For example, while the friction plates 32, 36 were used as the receiving portion of the automatic sheet supplying mechanism, one or both of the friction plates 32, 36 may be replaced by a roller member to apply an appropriate frictional force to the recording sheet 100. Further, while an example with the feed-in roller 34 having a triangular cross-section was explained, the present invention is not limited to this example, but it should be noted that the feed-in roller may have any desired polygonal cross-section.

A second embodiment of the present invention will be explained with reference to FIGS. 4 and 5.

Figure 4:
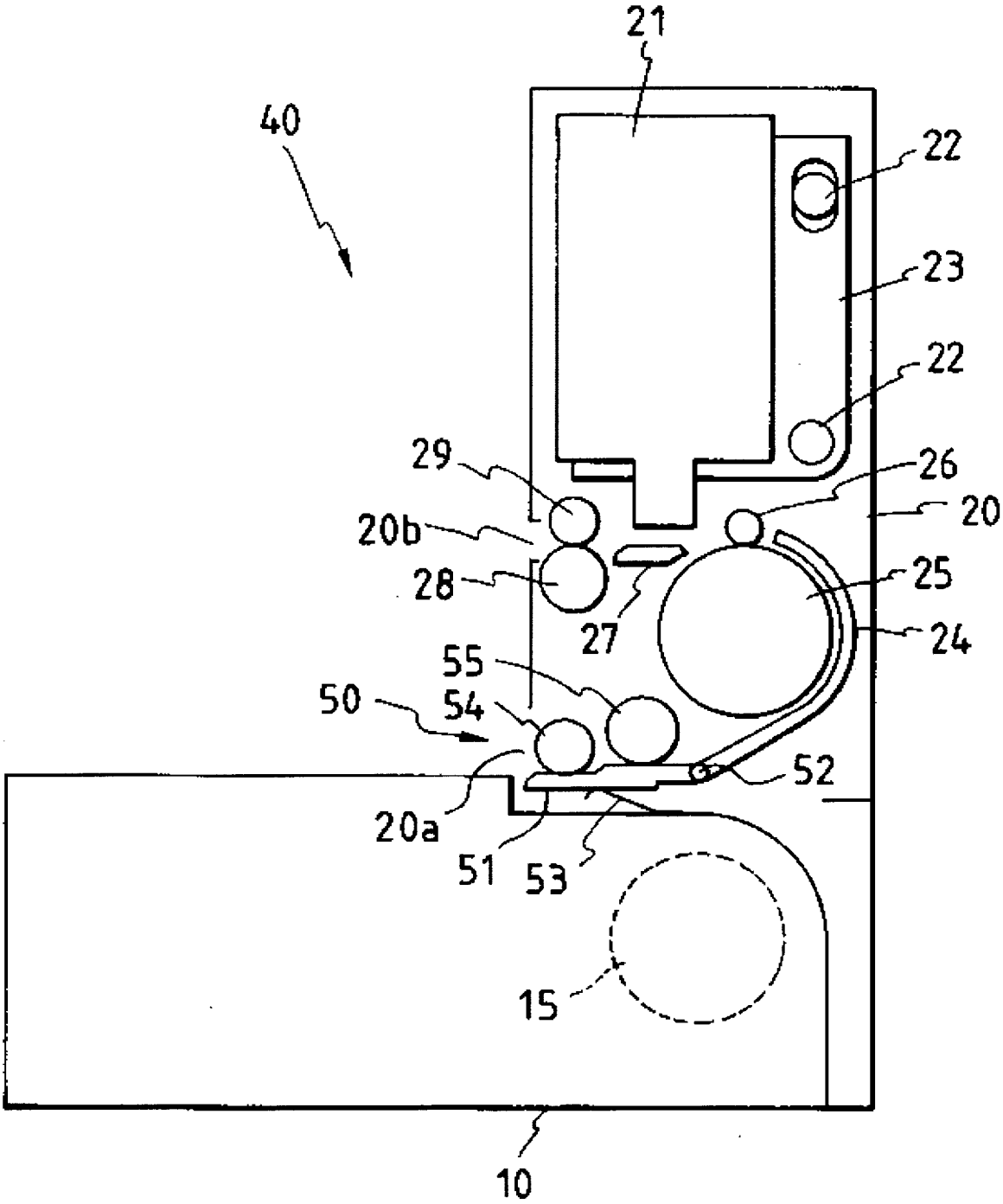
FIG. 4 is a schematic sectional view of a recording apparatus using a sheet supplying apparatus according to a second embodiment of the present invention, in its operative condition.
Figure 5:
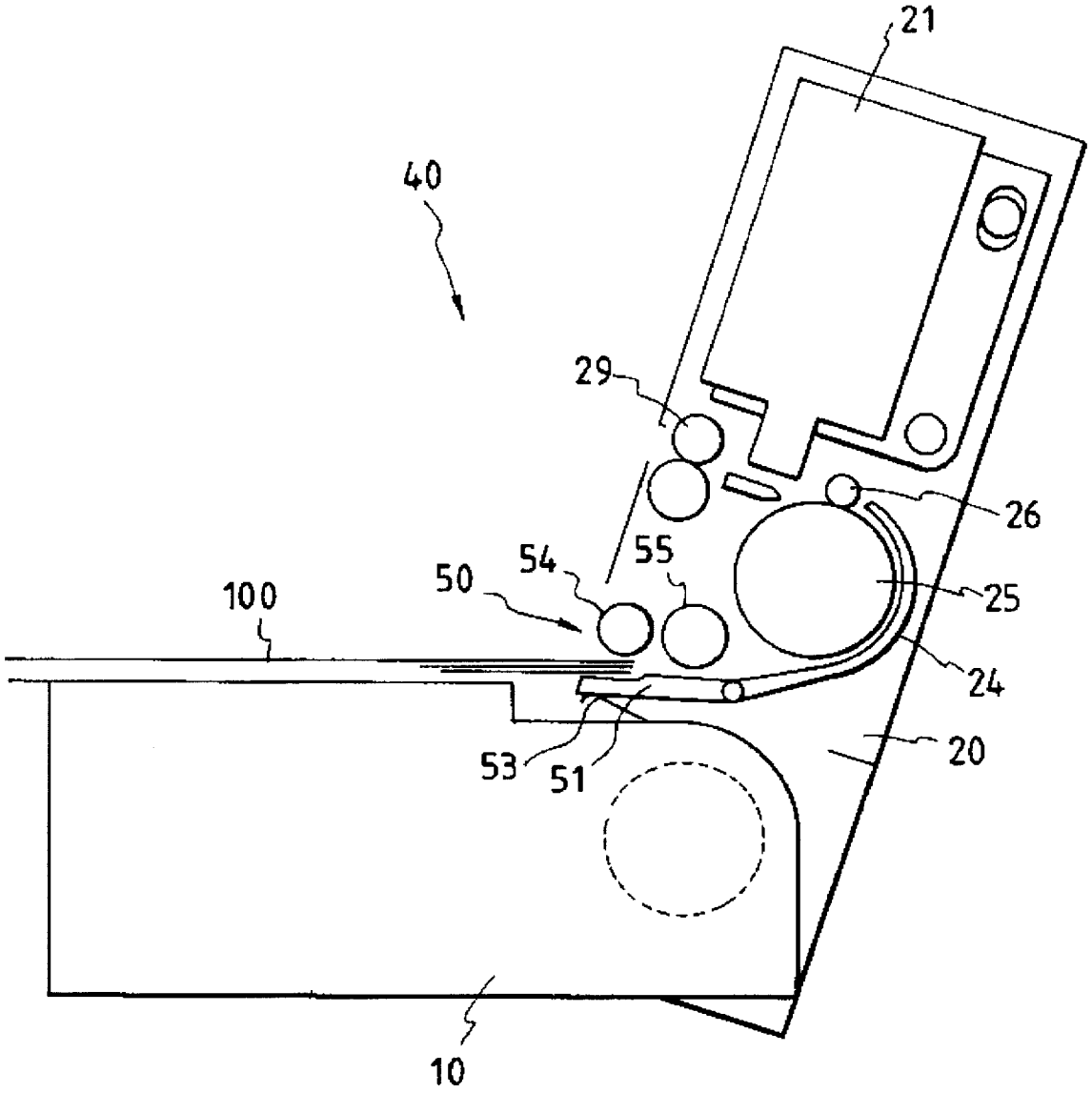
FIG. 5 is a schematic sectional view of the recording apparatus of FIG. 4 showing a condition that recording sheets are set and the jammed condition.

FIG. 4 is a schematic sectional view showing a recording apparatus according to the second embodiment in its operative condition, and FIG. 5 is a schematic sectional view showing a condition that a recording sheet is to be set. Incidentally, the same constructural elements as those shown in the first embodiments are designated by the same reference numerals.

The recording apparatus 40 according to this second embodiment differs from the recording apparatus of the first embodiment in the points that an automatic sheet supplying mechanism 50 is provided on the second frame 20 and the apparatus 40 can assume three configurations, i.e. an L-shaped configuration (FIG. 4), a flat configuration (not shown), and a third configuration as shown in FIG. 5.

The automatic sheet supplying mechanism 50 comprises a friction plate (receiving portion) 51 rotatably mounted on a front end of the guide 24, and a feed-in roller 54 and a separation roller 55 as a roller portion. The friction plate 51 is rotatably attached to the second frame via a pin 52 at its base end and is biased upwardly by a leaf spring 53 attached to the first frame 10. The pin 52 supporting the friction plate 51 has appropriate play with respect to the guide 24, so that the friction plate 51 biased by the leaf spring 53 can be urged against both of the feed-in roller 54 and the separation roller 55. On the other hand, the feed-in roller 54 is disposed in the proximity of the sheet supply opening 20*a* formed in the second frame 20, and the separation roller 55 is arranged rearwardly of the feed-in roller 54.

The second frame 20 including such a sheet supplying mechanism 50 is rotatably connected to the first frame 10 so that it can assume not only the L-shaped configuration (the second frame is folded at an angle of 90 degrees with respect to the first frame) and the flat configuration but also an angled configuration (third configuration) in which the feed-in roller 54 and the separation roller 55 are slightly separated from the friction plate 51 as shown in FIG. 5.

Accordingly, in the operative condition of the recording apparatus 40, the second frame 20 is slightly inclined from the L-shaped configuration as shown in FIG. 4 to the third configuration as shown in FIG. 5. In this condition, since the feed-in roller 54 and the separation roller 55 are slightly separated from the friction plate 51 to create a gap therebetween, a plurality of recording sheets 100 are inserted below the feed-in roller 54. Then, when the second frame 20 is returned to the L-shaped configuration as shown in FIG. 4, the plurality of recording sheets 100 are pinched between the feed-in roller 54 and the friction plate 51, thereby completing the setting of the recording sheets 100.

Thereafter, the automatic sheet supplying operation is effected in the same manner as the first embodiment.

On the other hand, if the recording sheet is jammed, the second frame 20 is slightly inclined again to assume the third configuration, thereby releasing the urging force of the feed-in roller 54 and the separation roller 55 from the jammed recording sheet 100. As a result, it is possible to easily remove the jammed recording sheet 100 from the apparatus 40.

Further, in the inoperative condition of the recording apparatus 40, the second frame 20 is rotated to make the apparatus 40 flat, thereby achieving the easy accommodation of the recording apparatus 40. In this flat configuration, since the contact areas between the friction plate 51 and the rollers are not exposed outwardly, the contact areas are prevented from in advertently smudging, with the result that the double-feed of the recording sheets and the poor feeding of the recording sheet due to the contamination of the contact areas can be prevented.

In conclusion, in the recording apparatus 40 according to the second embodiment, the first configuration or L-shaped configuration which is stable in the operative condition, the second configuration or flat configuration which permits the easy accommodation of the apparatus, and the third configuration in which the urging forces of the feed-in roller 54 and the separation roller 55 are released to permit the setting of the recording sheets and the jam treatment can be assumed.

With the arrangement as mentioned above, according to the second embodiment of the present invention, the whole recording apparatus can be made small-sized, and, since the automatic sheet supplying mechanism apparatus synchronously with the movement of the frame, a plurality of recording sheets can be successively supplied automatically, and further, the jam treatment can easily be effected only by rotating the frame.

Incidentally, the sheet supplying apparatus of the present invention can also be applied to a sheet treatment apparatus wherein a sheet is perforated and/or folded.

Figure 6:
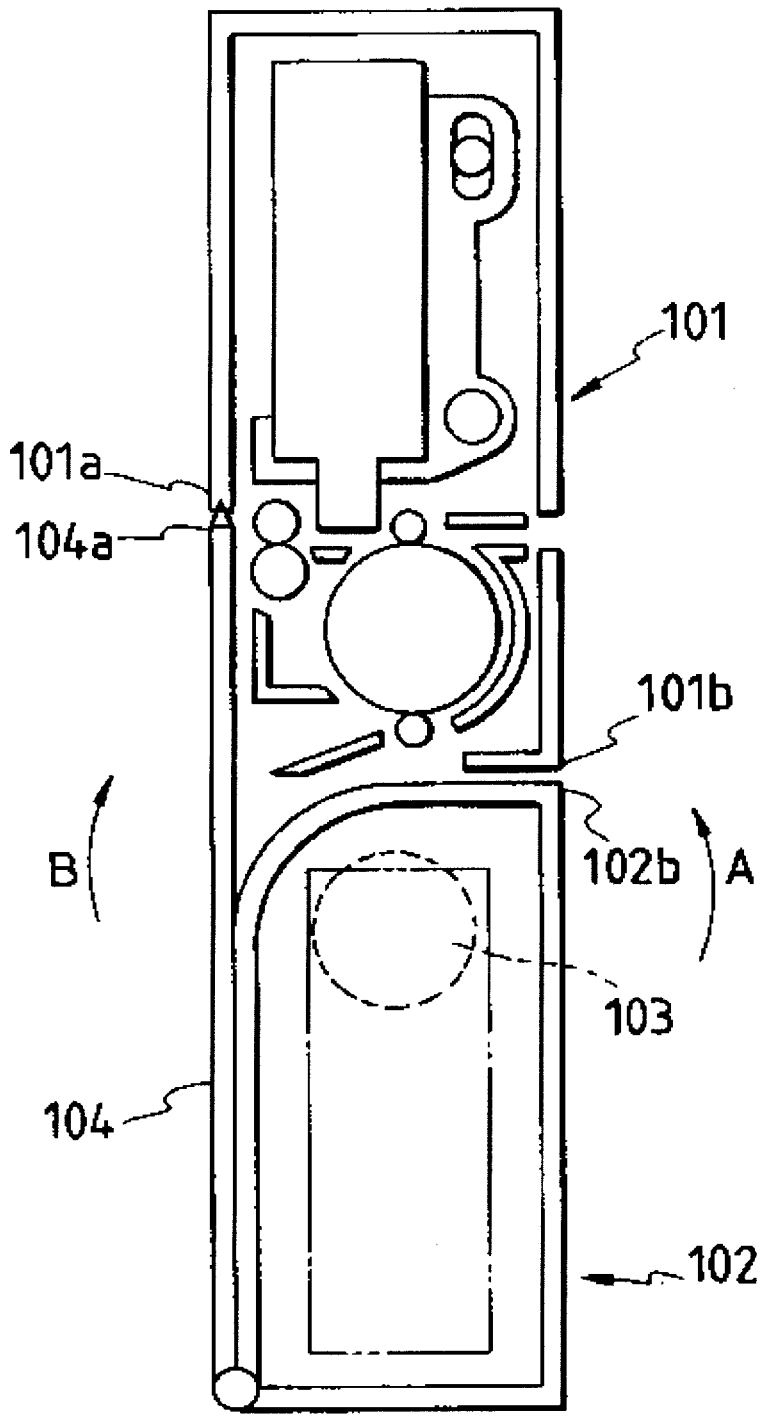
FIG. 6 is a sectional view of a recording apparatus using a sheet supplying apparatus according to a third embodiment of the present invention, in its accommodation condition.
Figure 7:
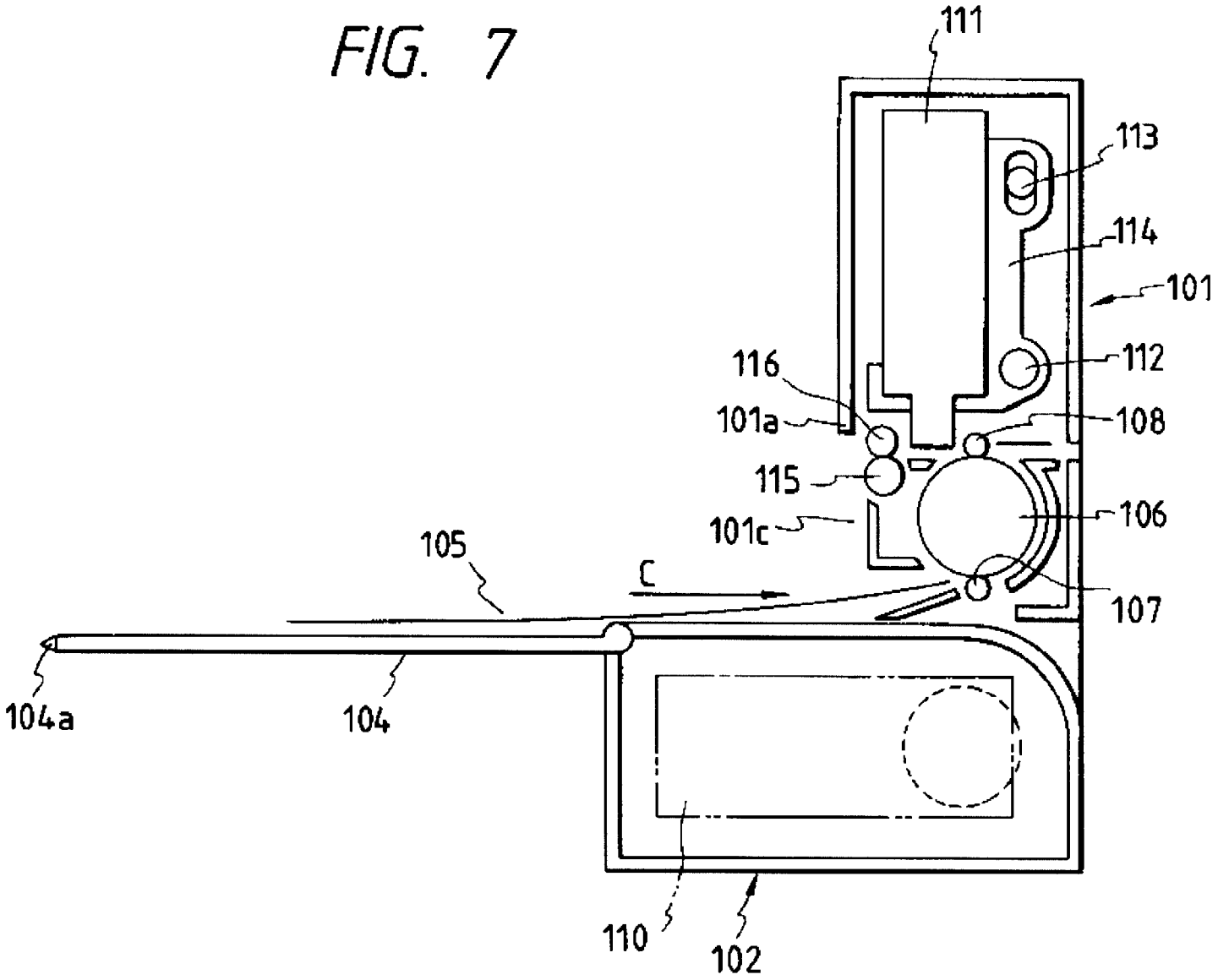
FIG. 7 is a schematic sectional view of the recording apparatus of FIG. 6 in its operative condition.

Next, a third embodiment of the present invention will be explained with reference to FIGS. 6 and 7. FIG. 6 is a sectional view showing an accommodation condition of a recording apparatus, and FIG. 7 is a sectional view showing an operative condition of the recording apparatus.

In FIG. 6, the recording apparatus according to the third embodiment comprises frames 101,102 pivotally connected to each other via a fulcrum 103. These frames form a constructural member. A cover member 104 is normally rested on one surface of the frame 102 and is pivotally connected to one end of the frame 102. A protruded portion 104*a* formed on a free end of the cover member 104 is normally engaged by a recessed portion 101*a* formed in one end of the frame 101.

In a condition shown in FIG. 6, i.e. in an accommodation and portable condition, even if the user tries to rotate the frame 102 in a direction shown by the arrow A, a portion 102*b* of the frame 102 is blocked by a portion 101*b* of the frame 101, thereby preventing the rotation of the frame 102. On the other hand, even if the user tries to rotate the frame 102 in a direction shown by the arrow B, the cover member 104 is blocked by the frame 101, thereby preventing the rotation of the frame 102. Accordingly, during the transportation of the recording apparatus, the unstable condition of the recording apparatus can be avoided. On the other hand, in an operative condition shown in FIG. 7, the protruded portion 104*a* of the cover member 104 is disengaged from the recessed portion 101*a* of the frame 101 and then the cover member is fully opened. Then, the frame 101 is rotated around the fulcrum 103 to establish a condition as shown in FIG. 7.

Now, the actual recording operation will be explained with reference to FIG. 7.

When a recording sheet 105 is rested on the cover member 104 opened as shown in FIG. 7 and is inserted toward a direction shown by the arrow C, the recording sheet 105 is pulled between a convey roller 106 and a pinch roller 107 by the rotation of the convey roller 106, thereby feeding the recording sheet. When the recording sheet 105 reaches a position below a recording head 111, the recording is started in response to a recording signal inputted to an electric portion 110. The recording head 111 is mounted on a carriage 114 supported by rails 112,113 so that one-line of an image can be recorded on the recording sheet as the carriage 114 is shifted. Whenever the recording of the one-line is finished, the recording sheet 105 is line-spaced by the roller 106. By repeating such operations, the recording sheet is ultimately discharged on the cover member 104 by discharge rollers 115,116.

In this way, the cover member 104 of the recording apparatus according to the third embodiment has a locking function for preventing the relative rotation between the frames 101, 102 around the fulcrum 103 during the accommodation or transportation, a tray function for supporting the recording sheet during the sheet supply and sheet discharge, and a cover function for covering an opening 101C of the frame 101, thereby preventing any play between the two frames of the recording apparatus during the accommodation and transportation of the recording apparatus.

Next, a fourth embodiment of the present invention will be explained with reference to FIG. 8.

Figure 8:
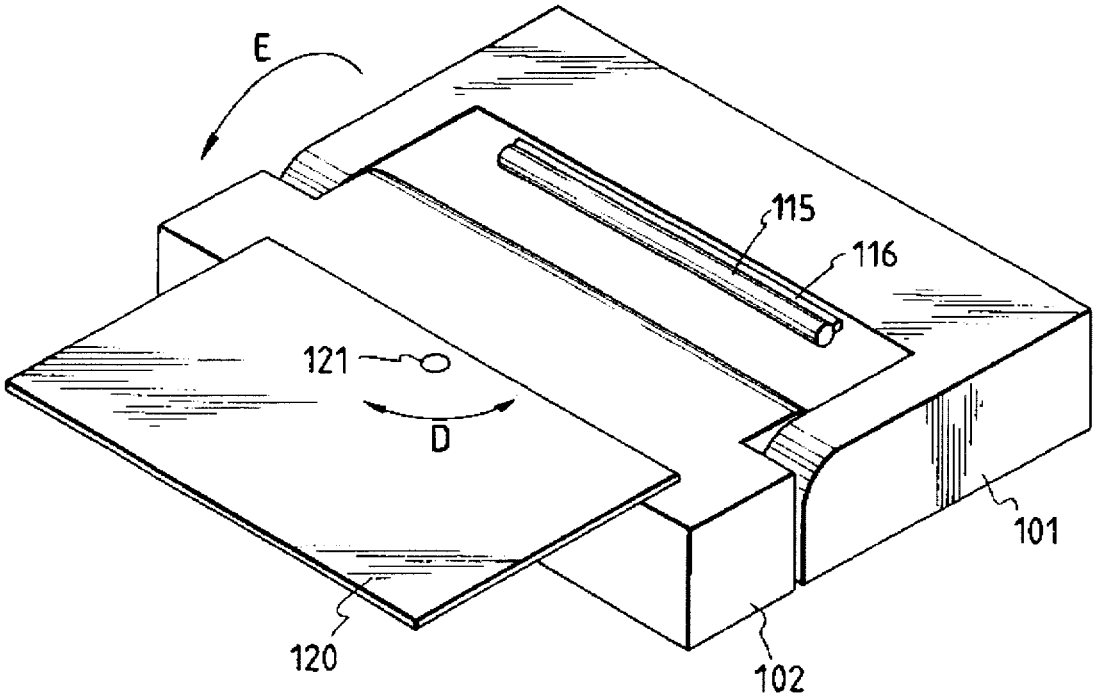
FIG. 8 is a perspective view of a recording apparatus using a sheet supplying apparatus according to a fourth embodiment of the present invention, in its accommodation condition.

FIG. 8 is a perspective view of a recording apparatus according to a fourth embodiment of the present invention in its accommodation condition. Since this fourth embodiment is fundamentally the same as the above-mentioned third embodiment, only the differences will be described.

In this fourth embodiment, a cover member 120 is pivotally connected to the frame 102 via a fulcrum 121 for rotational movement in directions shown by the arrow D. When the frame 101 is cocked in a direction shown by the arrow E from a condition shown in FIG. 8, an operative condition of the recording apparatus is established. In this condition, the cover member 120 serves as a tray. When the frame 101 is laid flat again and the cover member 120 is rotated in the direction D to cover or conceal the discharge rollers 115,116, a locking condition for preventing the rotation of the frame 101 in the direction E can be established.

Thus, the same technical effect as that of the third embodiment can be achieved.

Lastly, a fifth embodiment of the present invention will be explained with reference to FIG. 9.

Figure 9:
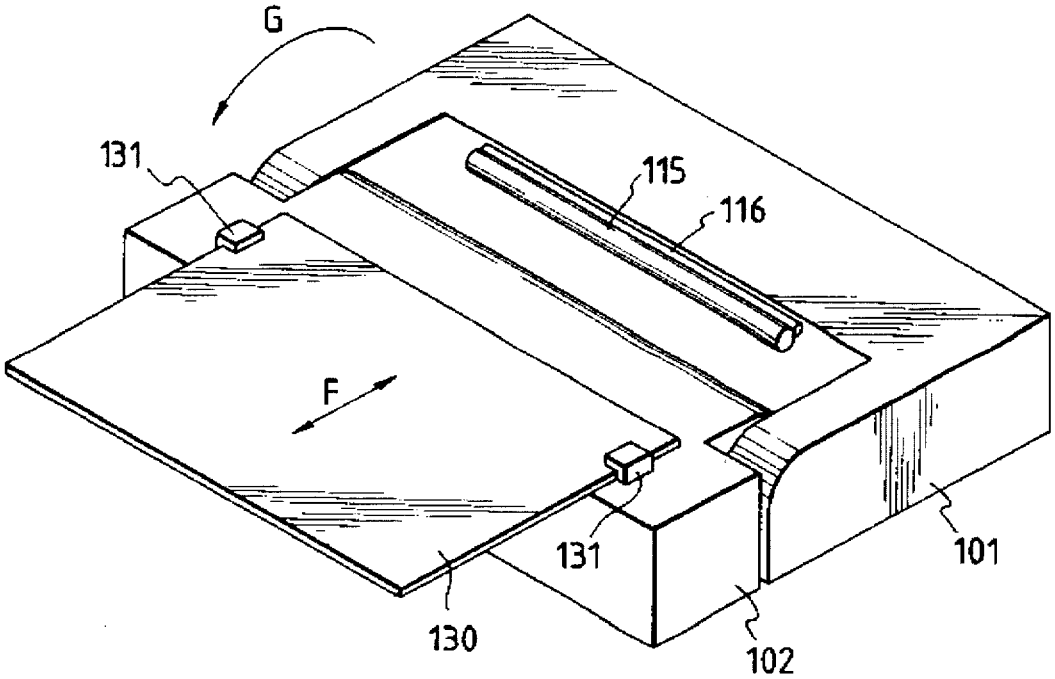
FIG. 9 is a perspective view of a recording apparatus using a sheet supplying apparatus according to a fifth embodiment of the present invention, in its accommodation condition.

FIG. 9 is a perspective view of a recording apparatus according to a fifth embodiment of the present invention in its accommodation condition. Since this fifth embodiment is fundamentally the same as the above-mentioned third embodiment, only the differences will be described.

In this fifth embodiment, a pair of opposed hook-shaped guide portions 131 are formed on one surface of the frame 102, and a cover member 130 is received between the guide portions 131 for sliding movement in directions shown by the arrow F. When the frame 101 is cocked in a direction shown by the arrow G from a condition shown in FIG. 9, an operative condition of the recording apparatus is established. In this condition, the cover member 130 serves as a tray. When the frame 101 is laid flat again and the cover member 130 is slid in the direction F to cover or conceal the discharge rollers 115,116, a locking condition for preventing the rotation of the frame 101 in the direction G can be established.

Thus, the same technical effect as that of the third embodiment can be achieved, and since the sliding amount of the cover member 130 can be adjusted appropriately, the recording apparatus can be installed in a narrower space.

According to this embodiment, the cover member is provided on the constructural member comprising two molded pieces rotatably connected to each other, and the cover member serves to prevent the relative rotation of the two molded pieces during the accommodation and transportation and also serves as a tray when the cover member is opened in the operative condition. Thus, the recording apparatus can assume the stable L-shaped configuration in its operative condition which permits recording. In the accommodation condition, the portable configuration having no play can be established.

Incidentally, the cover member may cover the sheet convey rollers, separation members, operation switches and connector members, as well as the inlet and outlet of the sheet conveying path.

What is claimed is:

1. A sheet supplying apparatus, comprising:

a first frame and a second frame shiftable relative to each other;

a mounting portion provided on said first frame for mounting a sheet thereon; and sheet supply means provided on said second frame adjacent to said mounting portion for supplying the sheet mounted on said mounting portion when said first frame and said second frame are in a first configuration, said sheet supply means being displaced from said mounting portion when said first frame and said second frame are in a second configuration, wherein, when viewed in a lateral direction, an angle between said first frame and said second frame is substantially 90° in the first configuration and is substantially 180° in the second configuration.

2. A sheet supplying apparatus according to claim 1, wherein said first frame and said second frame are pivotally connected to each other.

3. A sheet supplying apparatus according to claim 2, wherein said mounting portion and said sheet supply means are moved toward and away from each other in accordance with the rotation of said first frame relative to said second frame.

4. A sheet supplying apparatus according to claim 1, said first frame comprising an outer surface, an inner surface and a plurality of end surfaces and said second frame comprising an outer surface, an inner surface and a plurality of end surfaces, wherein, in the second configuration, said outer surface of said first frame and said outer surface of said second frame are substantially in the same plane.

5. A sheet supplying apparatus according to claim 4, wherein said first frame and said second frame are positionable in a third configuration, wherein, when viewed in a lateral direction, the angle between said first frame and said second frame in the third configuration is less than 180 degrees and greater than 90 degrees, and said sheet supply means is displaced from said mounting portion.

6. A sheet supplying apparatus according to claim 1, wherein said mounting portion comprises a friction plate, and said sheet supply means comprises a roller.

7. A sheet supplying apparatus according to claim 6, wherein a plurality of stacked sheets are mounted on said mounting portion, and wherein, when said first frame and said second frame are in the first configuration, said friction plate and said roller cooperate with each other to separate a single sheet from the plurality of stacked sheets.

8. A sheet supplying apparatus according to claim 1, further comprising recording means for recording an image on the sheet supplied by said sheet supply means.

9. A sheet supplying apparatus according to claim 8, wherein said recording means uses thermal energy to form an ink droplet and records the image on the sheet by utilizing the formed ink droplet.

10. A sheet recording apparatus, comprising:

a first frame and a second frame shiftable relative to each other;

a mounting portion provided on said first frame for mounting a sheet thereon;

sheet supply means provided on said second frame for supplying the sheet mounted on said mounting portion when said first frame and said second frame are in a first configuration, said sheet supply means being displaced from said mounting portion when said first frame and said second frame are in a second configuration; and recording means for recording an image on the sheet supplied by said sheet supply means, wherein, when viewed in a lateral direction, an angle between said first frame and said second frame is substantially 90° in the first configuration and is substantially 180° in the second configuration.

11. A sheet recording apparatus according to claim 10, wherein said recording means uses thermal energy to form an ink droplet and records the image on the sheet by utilizing the formed ink droplet.

* * * * *

UNITED STATES PATENT AND TRADEMARK OFFICE

CERTIFICATE OF CORRECTION

PATENT NO. : 5,538,237
DATED : July 23, 1996
INVENTOR(S) : YASUO MIAUCHI

It is certified that error appears in the above-indentified patent and that said Letters Patent is hereby corrected as shown below:

Column 1,
line 10, "relates" should read --relates to--.

Column 3,
line 7, "away" should read --away from--.

Column 5,
line 2, "is" should be deleted.

Column 7,
line 38, "in advertently" should read --inadvertently--.

Signed and Sealed this

Tenth Day of December, 1996

*Attest:*

Bruce Lehman

BRUCE LEHMAN

*Attesting Officer*

*Commissioner of Patents and Trademarks*